US006250224B1

(12) United States Patent
Hofmann et al.

(10) Patent No.: US 6,250,224 B1
(45) Date of Patent: Jun. 26, 2001

(54) POWDER SPRAYER

(76) Inventors: Hans J. Hofmann, 2472 Saluda Dr., Acworth, GA (US) 30101; Mark A. DiRico, 774 Norfolk St., Mansfield, MA (US) 02048

( * ) Notice: Subject to any disclaimer, the term of this patent is extended or adjusted under 35 U.S.C. 154(b) by 0 days.

(21) Appl. No.: 09/441,413

(22) Filed: Nov. 16, 1999

(Under 37 CFR 1.47)

Related U.S. Application Data

(63) Continuation of application No. 08/958,347, filed on Oct. 27, 1997, now abandoned.

(51) Int. Cl.[7] ..... B41F 23/06

(52) U.S. Cl. ..... 101/424.2; 101/416.1; 118/309; 118/DIG. 1; 239/654

(58) Field of Search ..... 101/424.2, 416.1, 101/417, 419; 118/308, 309, 310, 315, DIG. 1; 239/654, 142, 143

(56) References Cited

U.S. PATENT DOCUMENTS

| | | | | |
|---|---|---|---|---|
| 697,374 | * | 4/1902 | Stuart et al. | 101/424.2 |
| 2,093,995 | | 9/1937 | Blow | 101/424.2 |
| 2,703,551 | * | 3/1955 | Daniels | 101/416.1 |
| 2,817,310 | * | 12/1957 | Ponzini | 101/424.2 |
| 3,606,087 | | 9/1971 | Ortman | 101/424.2 |
| 3,764,070 | | 10/1973 | Glaser | 239/93 |
| 4,332,198 | | 6/1982 | Schmoeger | 101/416 B |
| 4,622,896 | | 11/1986 | Laverick | 101/416 R |
| 4,867,063 | * | 9/1989 | Baker et al. | 101/424.2 |
| 5,090,626 | * | 2/1992 | Platsch | 239/654 |
| 5,713,285 | | 2/1998 | Reed et al. | 101/424.2 |

FOREIGN PATENT DOCUMENTS

| | | | |
|---|---|---|---|
| 222061 | 1/1990 | (JP) | 101/424.2 |

OTHER PUBLICATIONS

Grafix product brochure.
Weko product brochure.

* cited by examiner

*Primary Examiner*—John S. Hilten
*Assistant Examiner*—Leslie J. Grohusky
(74) *Attorney, Agent, or Firm*—Thomas, Kayden, Horstemeyer & Risley, LLP

(57) ABSTRACT

A powder sprayer unit which provides improved spraying of powder onto printed sheets of material produced in printing presses. The powder sprayer includes a source of pressurized fluid, a source of powder, a mixer and a distributor. The mixer includes at least one fluid inlet positioned to receive fluid from the fluid source, and at least one powder inlet positioned to receive powder from the source of powder to mix the fluid and the powder forming a fluid/powder mixture. The distributor-includes a disperser positioned to disperse the mixture as it flows to a plurality of nozzles. The nozzles are positioned to spray the dispersed mixture onto specified areas of printed sheets of material having passed through the printing press.

2 Claims, 9 Drawing Sheets

POWDER SPRAYER

CROSS-REFERENCE TO RELATED APPLICATION

The present application is a continuation of and claims the benefit of the filing date of U.S. patent application Ser. No. 08/958,347, filed Oct. 27, 1997 now abandoned.

TECHNICAL FIELD OF THE INVENTION

This invention relates powder sprayers in printing presses.

BACKGROUND OF THE INVENTION

Offset printing presses can produce several hundred sheets of printed material per minute. In most cases, the ink is still tacky when the printed sheets come from the printing press so that when the sheets are stacked together the ink from each of the printed sheets may be partially transferred to or it may adhere to the backside of an adjacent sheet. Thus, powder is often sprayed onto the sheets prior to stacking the sheets to prevent the transfer of ink. The powder also facilitates movement of the sheets by an operator by reducing the friction between the stacked sheets.

Laverick, U.S. Pat. No. 4,622,896, discloses a powder spray gun attachment for a sheet delivery tray of a printing press.

Schmoeger, U.S. Pat. No. 4,332,198, discloses an air assist powdering system having a solenoid valve for actuating the powdering system.

SUMMARY OF THE INVENTION

One aspect of the invention features a powder sprayer unit which provides improved spraying of powder onto printed sheets of material produced in printing presses. This aspect of the invention generally includes a source of pressurized fluid, a source of powder, a mixer and a distributor. The mixer includes at least one fluid inlet positioned to receive fluid from the fluid source, and at least one powder inlet positioned to receive powder from the source of powder. The mixer mixes the fluid and the powder forming a fluid/powder mixture. The distributor includes a disperser positioned to disperse the mixture as it flows to a plurality of nozzles. The nozzles are positioned to spray the dispersed mixture onto specified areas of printed sheets of material.

Among other advantages, the powder sprayer unit of the present invention is able to uniformly spray the air/powder mixture onto sheets of material without forming local accumulations of powder on the sheets.

Embodiments of this aspect of the invention may include one or more of the following features.

The distributor may be a distribution chamber, and the mixer may include a mixing chamber having an outlet providing the mixture to an inlet for the distribution chamber. The disperser may be positioned near the inlet of the distribution chamber. The distributor may also include a plurality of outlets in flow communication with the nozzles. The outlets may be connected to the nozzles with cylindrical tubes.

The mixer may include a rotatable cylindrical roller that effectuates the mixing of the fluid and powder to produce the fluid/powder mixture. The roller may be rotated by a motor. A sensor may be included in such an arrangement to detect inadvertent stoppage of the motor, so that an alarm is activated indicating the stoppage of the motor.

A powder reservoir may be used as the source of powder. A detector may be used to detect low levels of powder in the reservoir; preferably, the detector is a fiber optics detector.

The printed sheets of material may be stacked in a stacking area, and, preferably, the powder prevents the transfer of printed matter between adjacent printed sheets of material. The powder may also facilitate movement of adjacent printed sheets of material.

The above described powder sprayer unit may be used in a method to spray powder onto printed sheets of material having passed through a printing press.

Other features and advantages of the invention will become apparent from the following description and drawings.

DETAILED DESCRIPTION OF THE DRAWINGS

Figure 1:
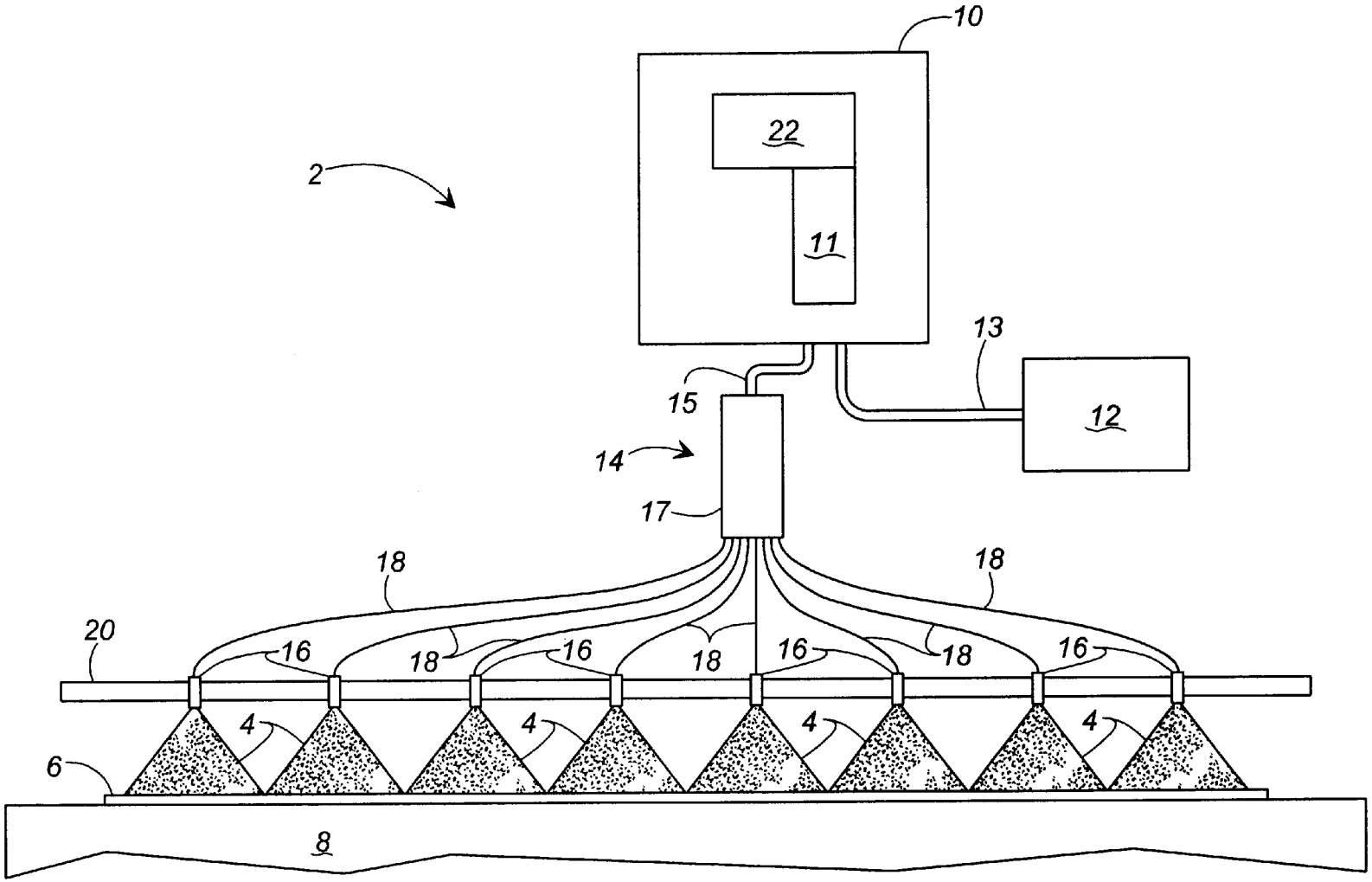
FIG. 1 is a diagrammatic view of a powder sprayer unit for a printing press.

In FIG. 1, a powder sprayer unit 2 is positioned to spray an air/powder mixture 4 across the width of a sheet of material 6 being fed lengthwise by conveyor 8. The powder sprayer unit 2 includes a mixer unit 10 having a mixing chamber assembly 11 connected in flow communication through inlet conduit 13 with a source of pressurized air 12, and through outlet conduit 15 with a sprayer head assembly 14. Sprayer head assembly 14 is further connected in flow communication with nozzles 16 though distributor hoses 18, nozzles 16 being supported by support bar 20. The air/powder mixture 4 produced in mixing chamber assembly 11, to which air is supplied by air source 12 and powder is supplied by a powder reservoir 22, is connected in flow communication with mixing chamber assembly 11. Although in the illustrated embodiment the powder is mixed with air, fluids or gases other than air may be used.

Figure 2:
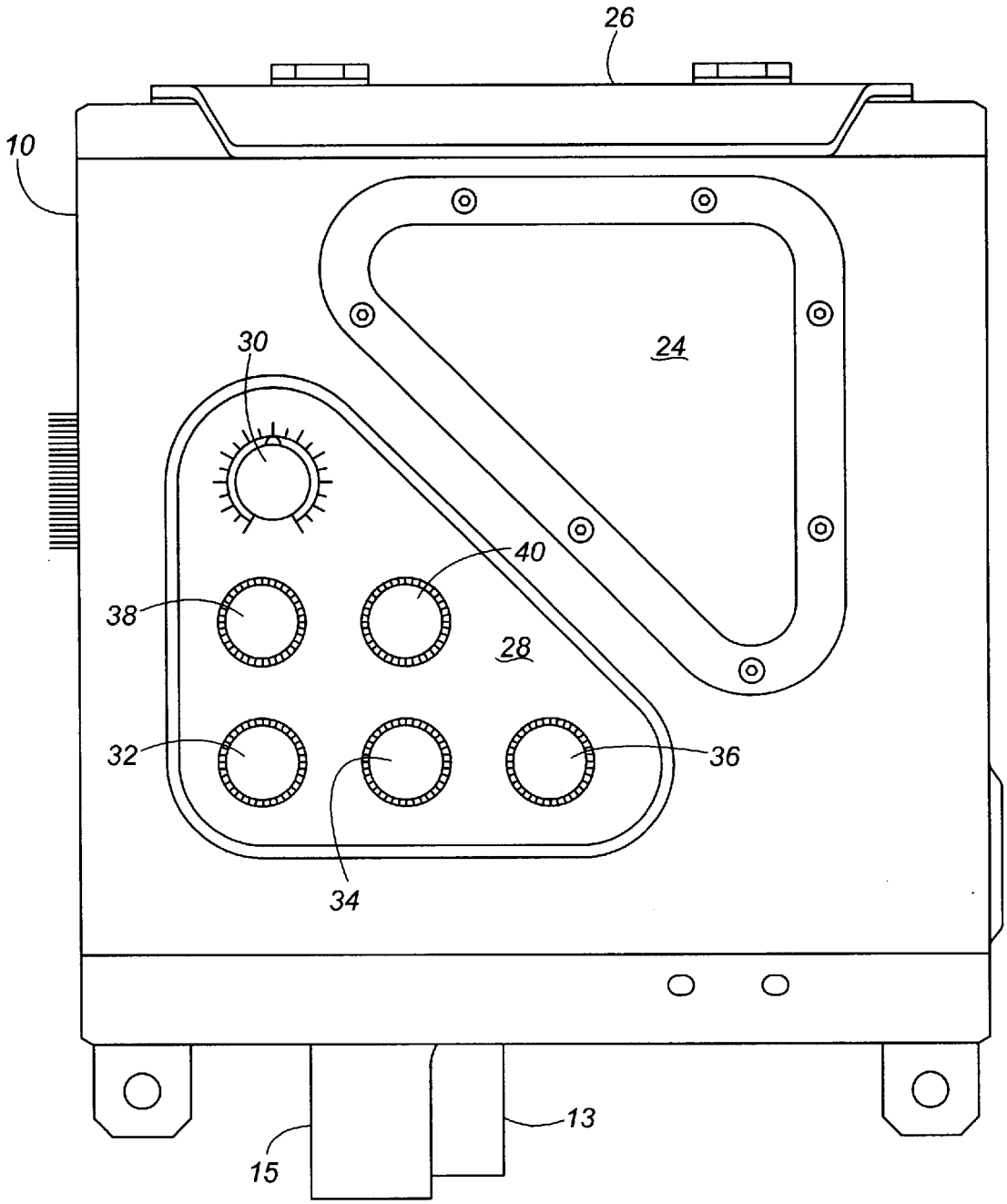
FIG. 2 is a front view of a mixer unit.
Figure 2A:
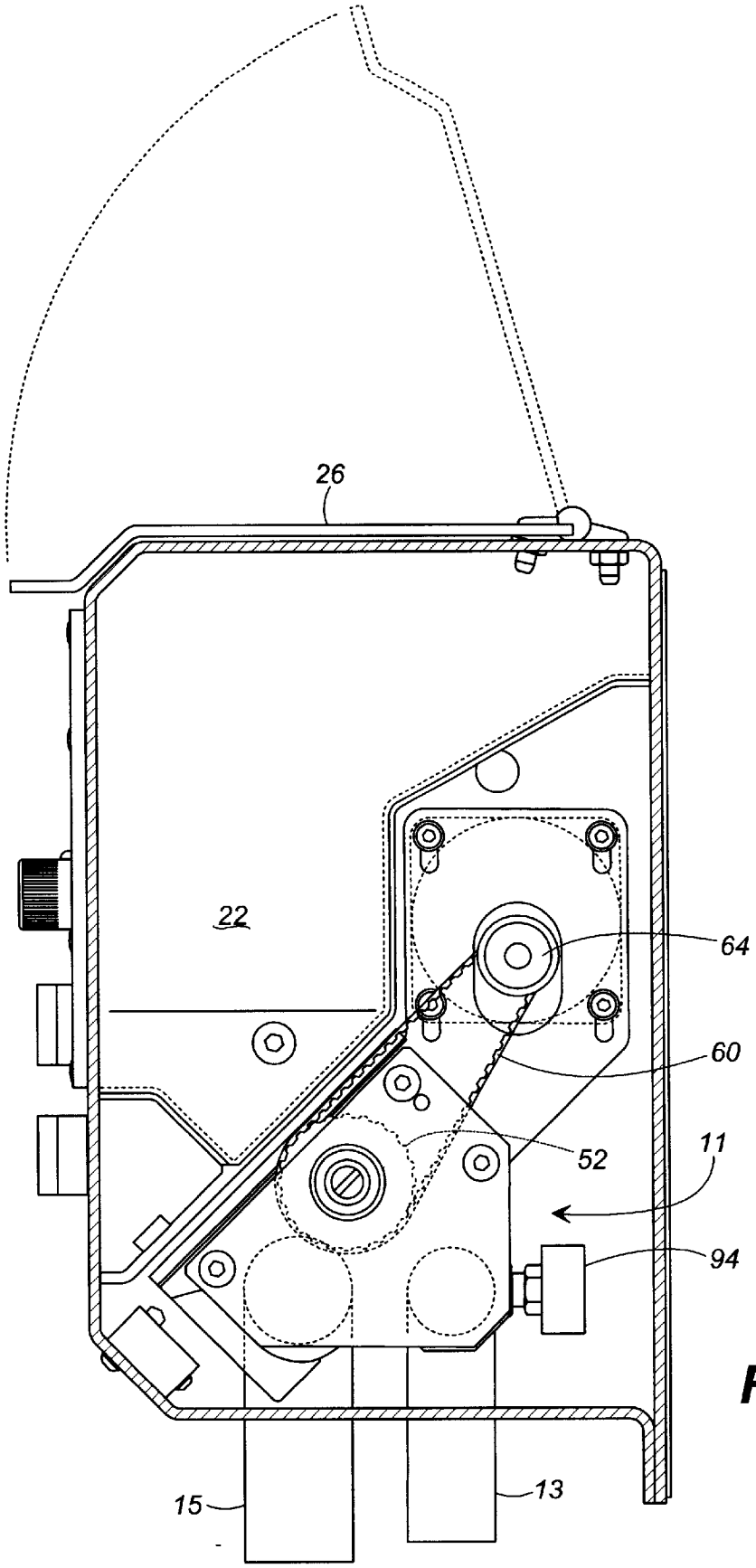
FIG. 2*a* is a side sectional view of the mixer unit of FIG. 2.

Referring to FIGS. 2 and 2*a*, mixer unit 10 includes a window 24 and a lid 26 pivotally attached to the top of the unit. Lid 26 enables the replenishing of powder reservoir 22 when the amount of powder supply becomes too low so that the unit can be refilled during operation without interruption of the spraying process. The supply of powder is visually monitored by an operator viewing through window 24. Mixer unit 10 is controlled by a control unit 28.

Control unit 28 contains control and monitoring functions for the powder sprayer unit system, including powder dispensing, line pressure, and reservoir level. The front of the control unit includes a control panel having a volumetric control knob 30, power-on button 32, alarm button 34, impression (IMP) indication test button 36, static bar button 38, and reduced coverage button 40. Volumetric control knob 30 controls the air to powder ratio in the air/powder mixture 4. Power-on button 32 activates the system. Alarm button 34 is depressed by the operator to activate an alarm and to shut down the system when undesirable conditions are detected. IMP test button 36 activates a simulation print sequence as if the printing press in actually running to verify that the air/powder mixture is properly sprayed out of nozzles 16. At the discretion of the operator, static bar button 38 is depressed to cause sheet of material 6 to become positively charged so as to attract the powder that has been negatively charged. Certain applications require less than full spray coverage (across the width) of the sheet of material. In these cases, the reduced coverage feature of the system is activated with reduced coverage button 40 to reduce the amount of material covered by about 20%, thereby preventing wastage of the powder.

Figure 3:
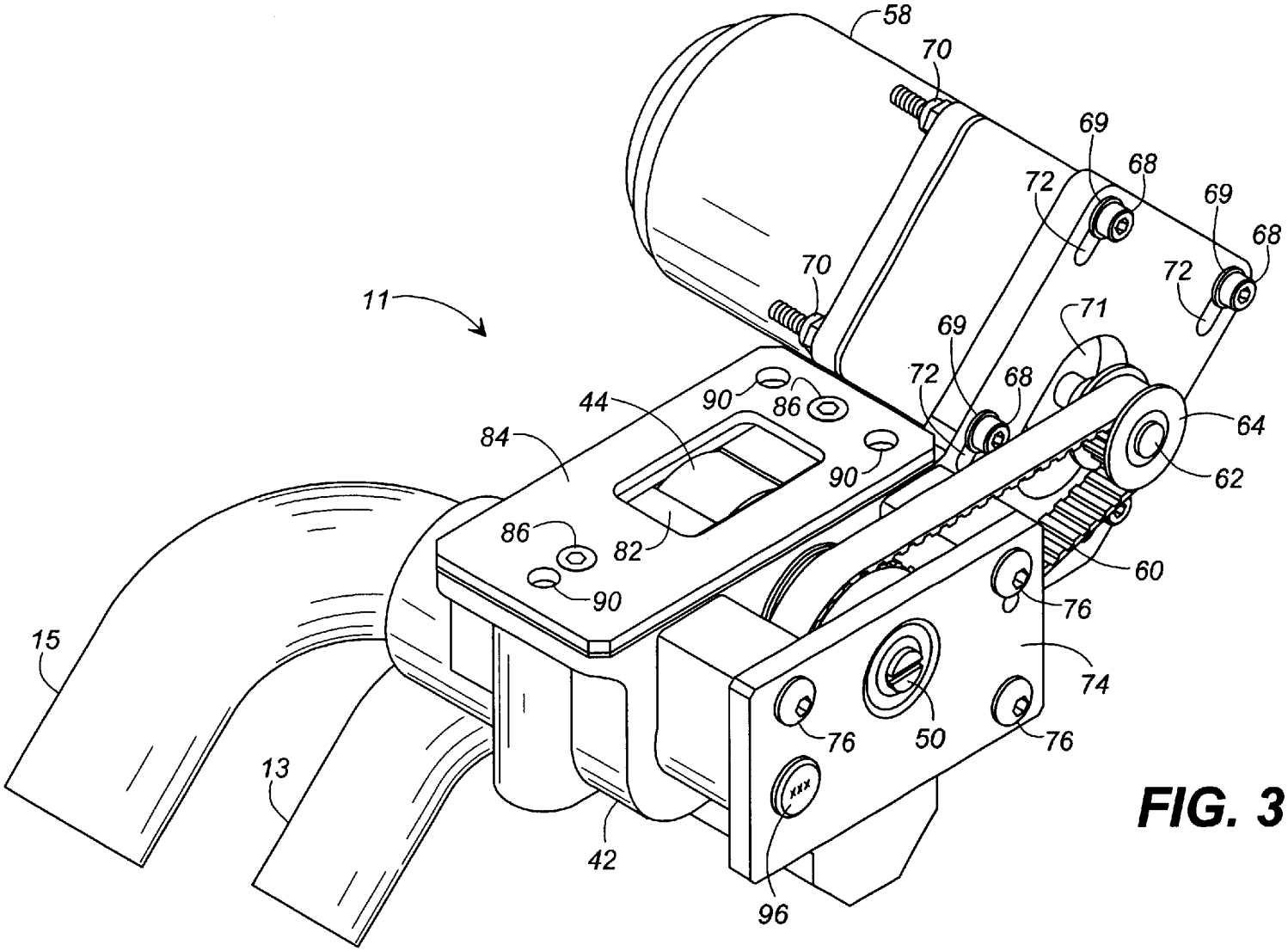
FIG. 3 is a profile view of a mixing chamber assembly.
Figure 3A:
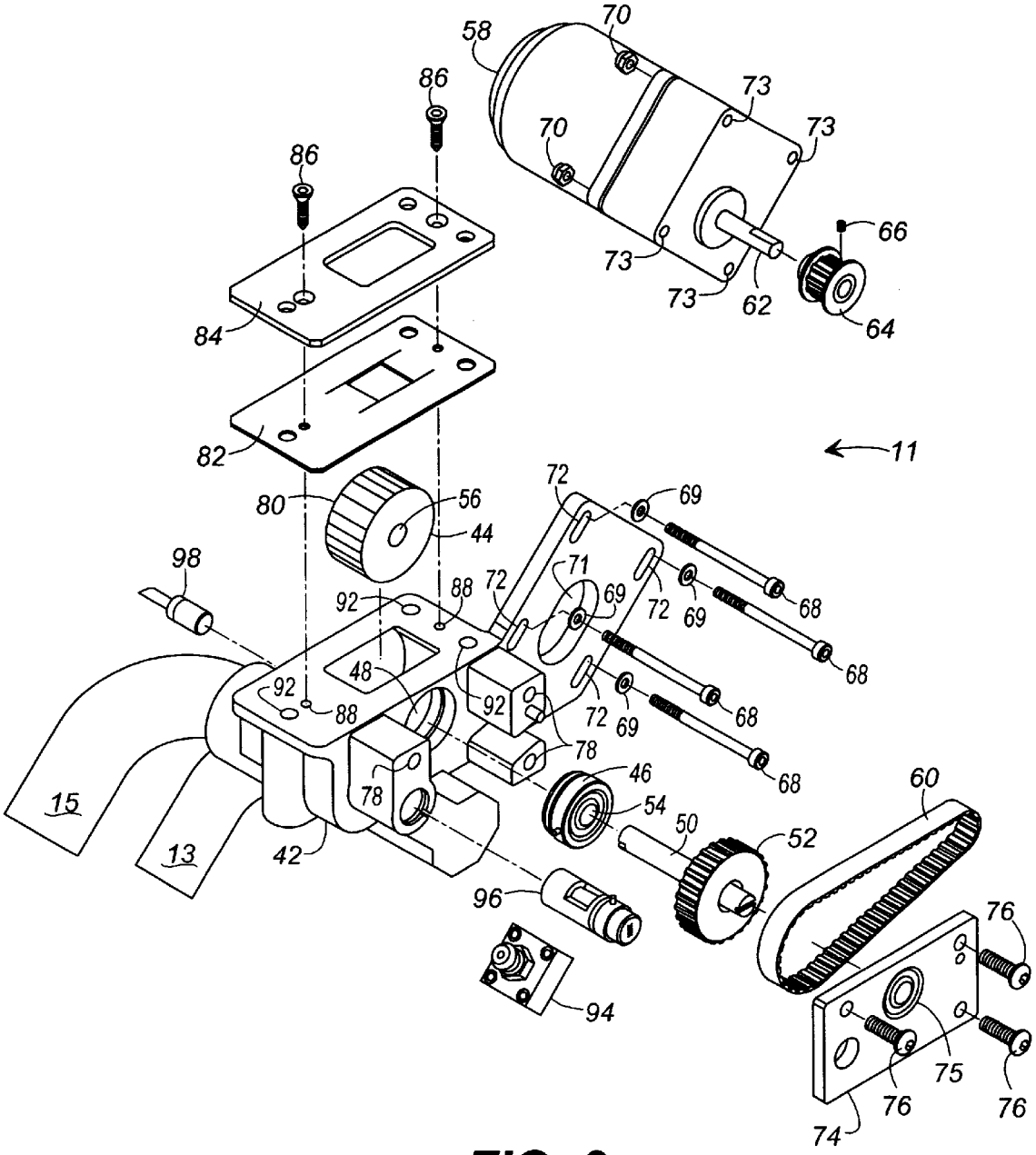
FIG. 3*a* is an expanded view of the mixing chamber assembly of FIG. 3.
Figure 3B:
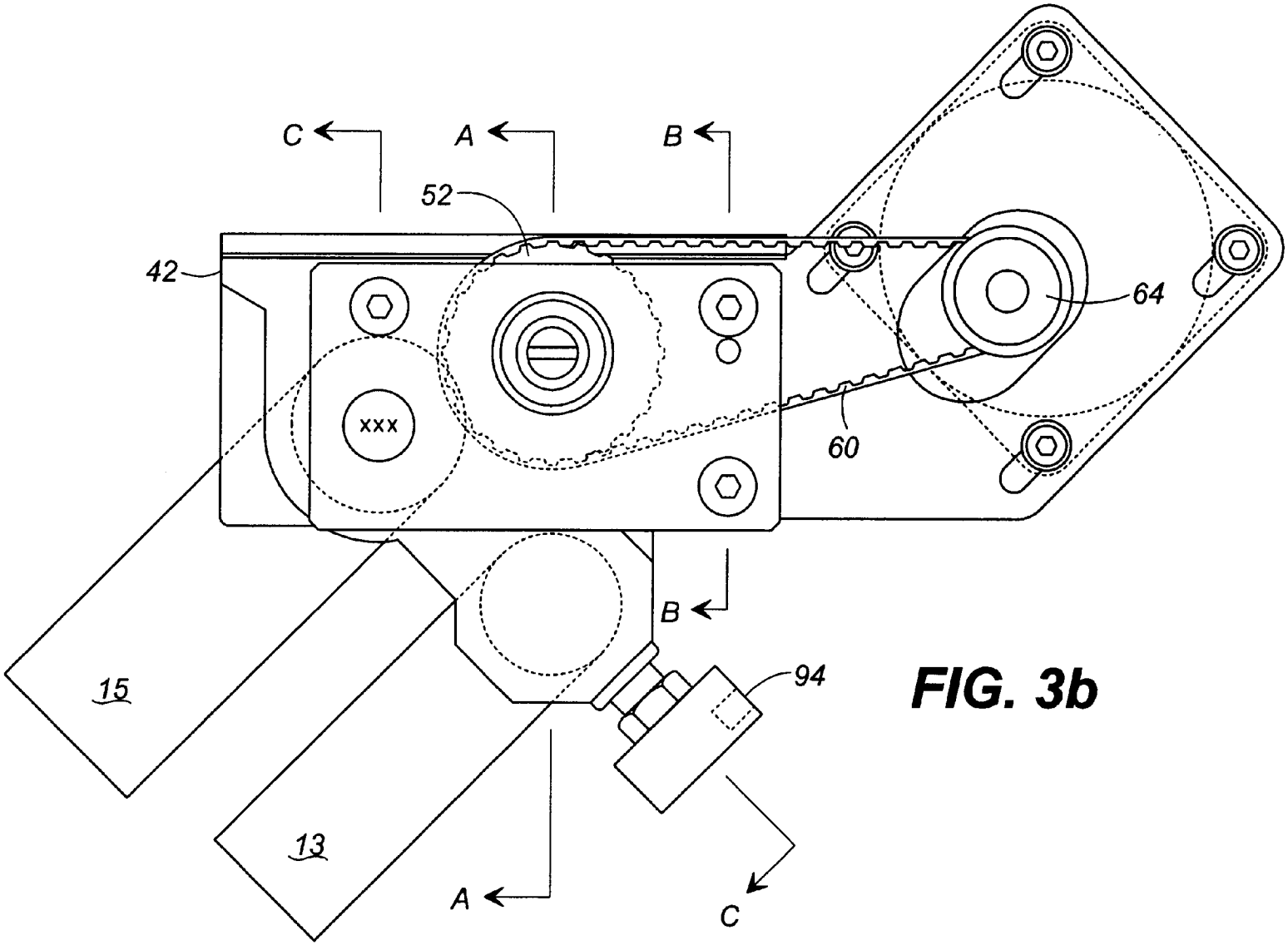
FIG. 3*b* is a side sectional view of the mixing chamber assembly of FIG. 3.
Figure 3C:
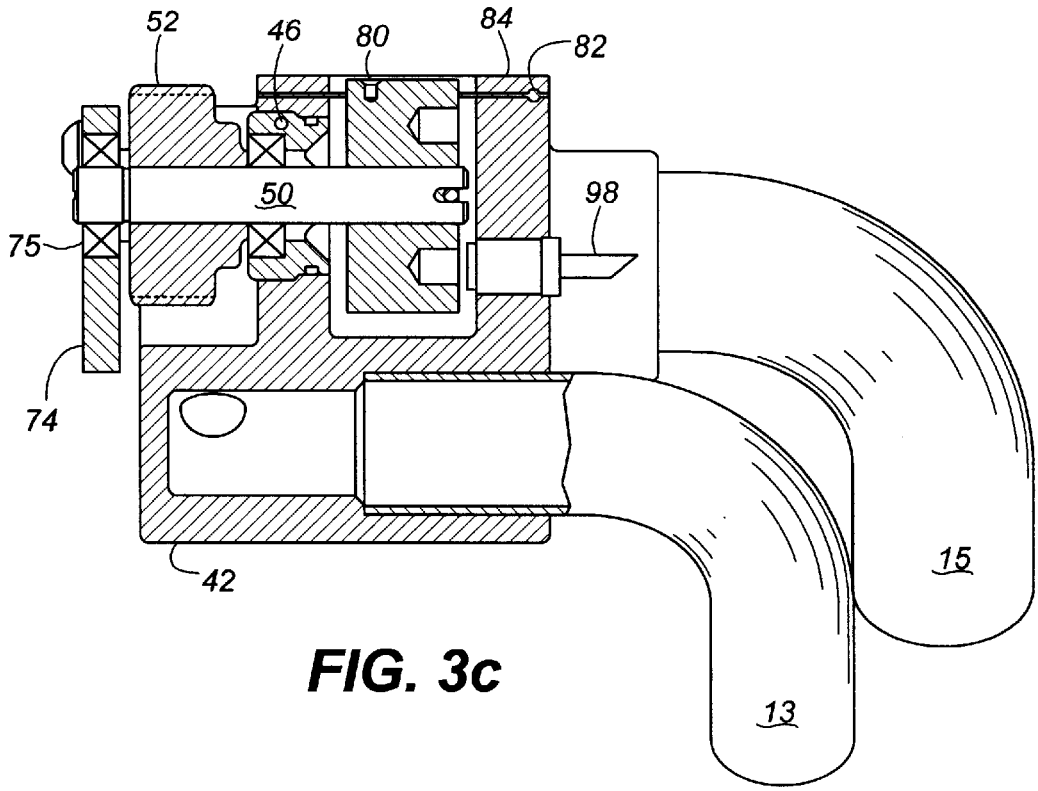
FIGS. 3*c*, 3*d* and 3*e* are cut-away views along lines AA, B—B and C—C, respectively, of the mixing chamber assembly of FIG. 3*b*.
Figure 3D:
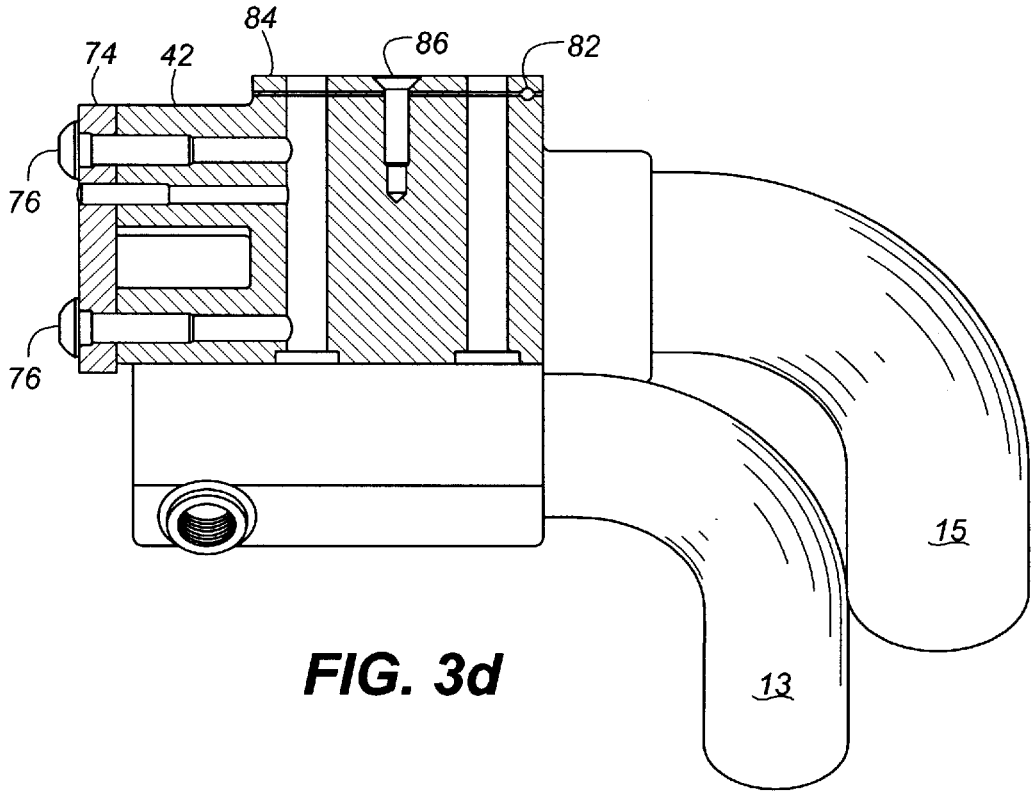
Figure 3E:
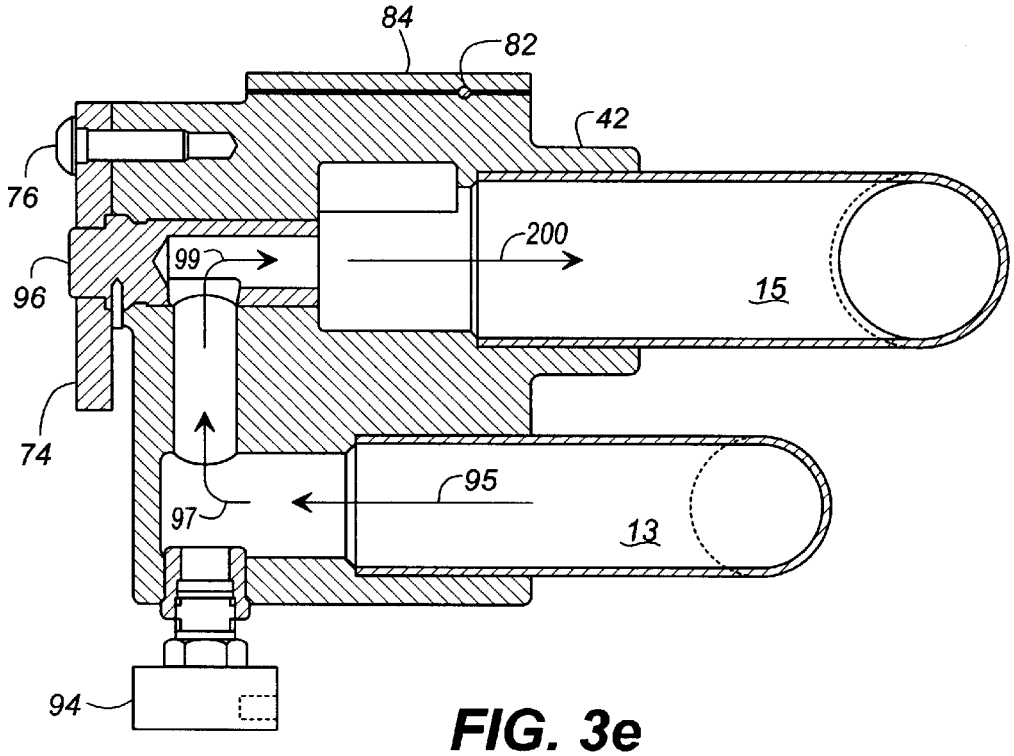

Referring to FIG. 3–3*e* and back to FIG. 2*a*, mixing chamber assembly 11 includes a block 42 connected to inlet conduit 13 and outlet conduit 15. A cylindrical anilox roller 44 is rotatably upported in block 42 by bearing 46 which is press fit into an orifice 48 of block 42. A spindle 50 connected to a transfer gear 52 is press fit into orifice 54 of bearing 46 and orifice 56 of anilox roller 44. A DC motor 58 is coupled to the transfer gear/spindle/anilox roll unit via a drive belt 60. DC motor 58 includes a motor spindle 62 onto which a drive gear is 64 is securely attached by a screw 66. In the illustrated embodiment, rotary motion of motor spindle 62 is transmitted to rotary motion of anilox roller 44 by the above described drive mechanism. Alternatively, DC motor 58 can be directly coupled to spindle 50, thereby directly driving anilox roller 44. Also, a roller with a generally spherical shape may be used instead of the cylindrical roller described above.

Motor 58 is secured to block 42 with screws 68, each of which extend through a respective hole 73, a block hole 72, and a washer 69, and in secured threaded engagement with a nut 70. Spindle 62 extends through elongated hole 71 of block 42. Hole 71 and block holes 72 are elongated to enable motor 58 to be slidably positioned. Gear 52 and spindle 50 are secured onto block 42 with a drive plate 74, drive plate 74 being fastened to block 42 with screws 76 in threaded engagement with holes 78 on block 42 with the motor spindle 50 extending through an opening 75 provided in the drive plate 74.

Anilox roller 44 includes a multiplicity of equally spaced indentations (e.g., about 200 indentations/inch) across the width of the roll and parallel to the axis of the roll. A scraper plate 82 is affixed to block 42 along with reinforcement plate 84 with screws 86 in secured engagement with threaded holes 88 of block 42. Powder reservoir 22 is securely fastened to block 42 by screws (not shown) passed through reinforcement plate holes 90 and secured in threaded engagement with threaded holes 92 of block 42.

The powder sprayer unit includes several safety features. For example, a pressure switch 94 signals an alarm when the air pressure from air source 12 is too low. Pressure switch is disposed on block 42 and is in flow communication with the air flow through inlet conduit 13. Another alarm 98 also attached to block 42 signals an alarm when the motor/anilox roll assembly inadvertently shuts down.

Another feature of the illustrated embodiment is the ability to vary the air flow rate by merely replacing a replaceable orifice device 96. This feature enables the operator to employ different orifice device for different air/powder spray characteristics. For instance, when very wide sheets of material are being sprayed, a larger orifice is used. Similarly, when narrower sheets are sprayed a smaller orifice can be employed.

Figure 4:
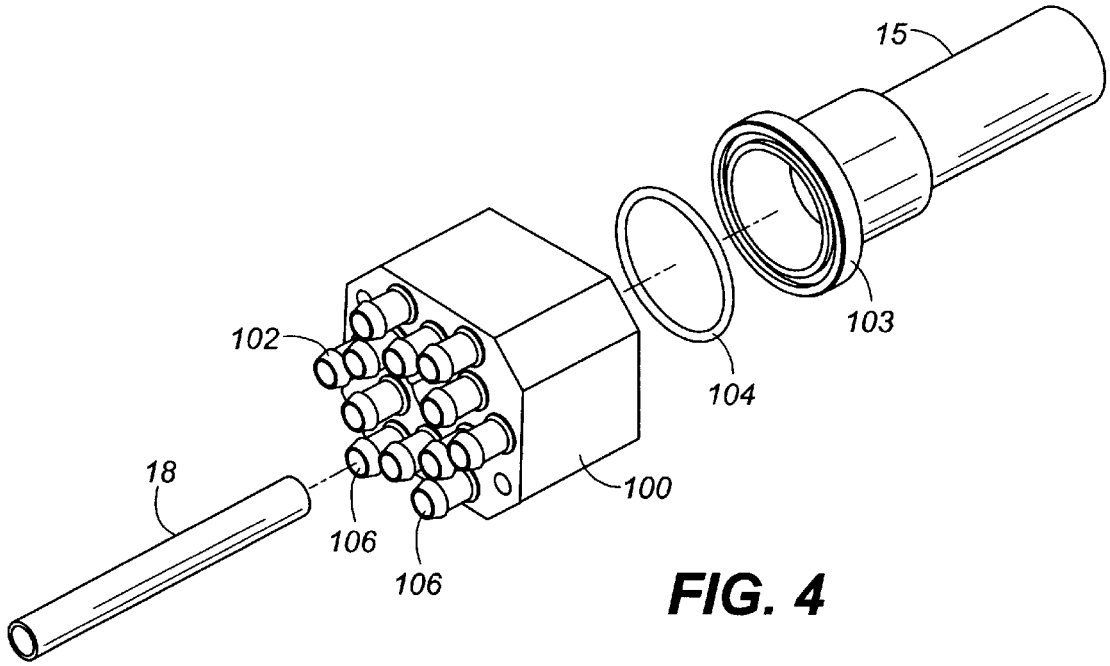
FIG. 4 is a profile view of a distributor assembly.
Figure 4A:
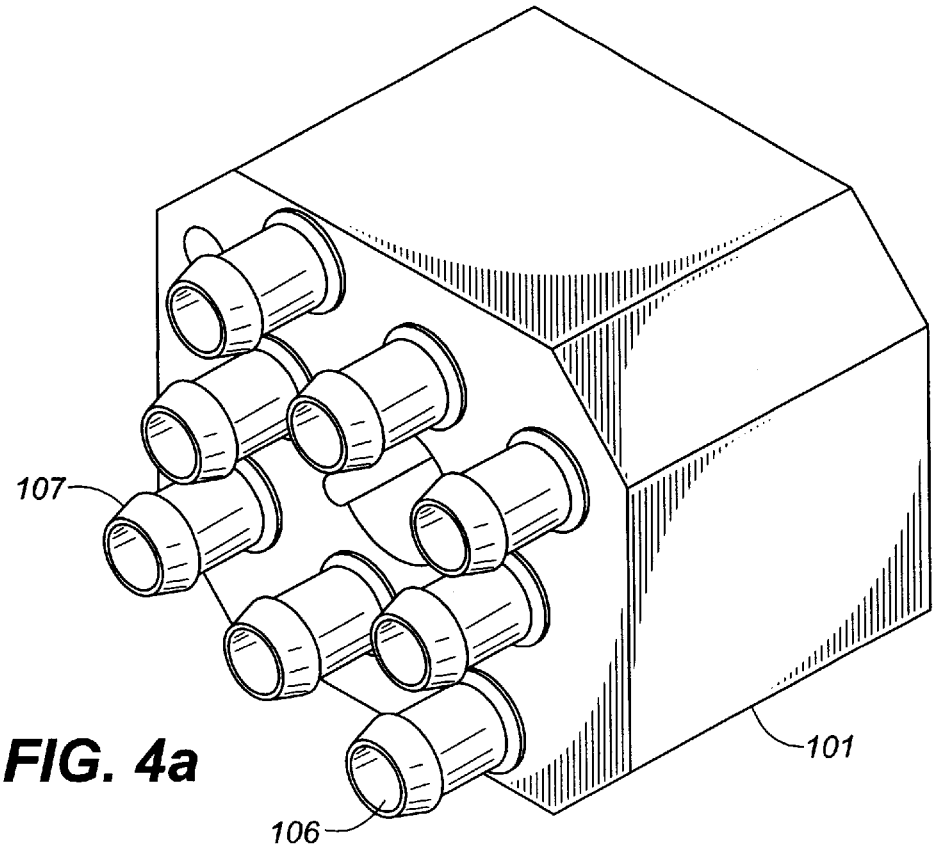
FIG. 4*a* is a profile view of an eight-outlet distributor.

Referring back to FIG. 1 and to FIG. 4, mixing chamber assembly 14 includes a distributor 106 with a back side connected to a distal end 103 of outlet conduit 15 in sealed engagement with a washer 104, all of which are housed in a housing 17. The connection between the distributor and distal end 103 is maintained by securely fastening the unit to housing 17 with screws (not shown) passed through holes of distributor 100 and fastened in secured engagement with housing 17. Distributor 100 includes twelve outlets 106, each connected in flow communication with one end of a respective distributor hose 18, each distributor hose 18 being connected at its other end with spray nozzle 16 (FIG. 1). Normally, each outlet 106 is provided with an outlet tube 107. Distributor 100 may include more or less than twelve outlets. For example, FIG. 4*a* illustrates a distributor 101 with eight outlets 106. The number of outlets is determined by the width of the printed sheet of material being sprayed, that is, the wider the sheet, the larger the number of outlets and corresponding spray nozzles required to provide the appropriate coverage of the sheet.

Figure 4B:
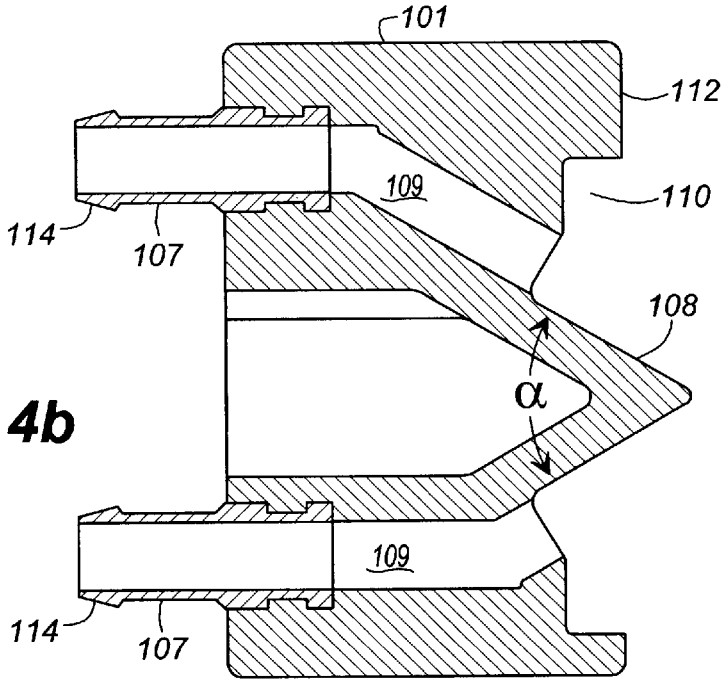
FIG. 4*b* is a side sectional view of the eight-outlet distributor of FIG. 4*a*.

Referring to FIG. 4*b*, distributor 100 (as well as other distributors) includes a generally cone shaped member for dispersing the air/powder mixture in equal portions through passages 109 to each outlet tube 107. FIG. 4*b* further illustrates a recessed region 110 on a back side 112 of distributor 101 into which washer 104 and distal end portion 103 is securely placed. The outer surface of cone 108 defines an angle, $\alpha$, of about 60°. Outlet tubes 107 include ridges 114 to ensure a sealed connection between distributor hose 18 and each tube outlet 107.

With reference to FIGS. 1 and 3–3*e*, air from air source 12 and powder from powder reservoir 22 are mixed in mixing chamber assembly 11. With particular reference to FIG. 3*e*, air flows through inlet conduit 13 in the general direction of arrow 95 and turns at a generally right angle as it moves through block 42 as indicated by arrow 97. The air flows turns again as it flows through orifice device 96, the flow direction being shown by arrow 99. In a mixing chamber 200 of block 42, the air mixes with a precisely controlled volume of powder. The volumetric rate of supplied powder is determined by the rotational speed of the anilox roll. As the anilox roll rotates, indentations 80 are filled with the powder supplied by powder reservoir 22. Scraper plate 22 scraps off excess powder from the periphery of the anilox roll. Thus each indentation filled with powder provides a precise volume of powder as it moves into mixing region 200 where the powder mixes with air, thereby producing the air/powder mixture having a predetermined ratio of air to powder. The mixture exits the mixing chamber assembly through outlet conduit 15 and is directed to sprayer head assembly 14. As the mixture encounters distributor 100 or it is dispersed by dispenser 108 so that equal proportions of mixture are directed to each tube 107. From outlet tube 107 the mixture is directed through distributor hoses 18 to spray nozzles 16 from each of which a fan shaped spray is ejected onto the printed sheet of material. The width of sprayed area as well as the thickness of the powder sprayed onto the material is a function of the distance between nozzles 16 and sheets 6. The thickness also being controlled by the speed at which the sheets are fed through the sprayer unit.

It is understood that for one skilled in the art the invention not limited to above description. Broad aspects of the invention can be realized in other ways. Thus, any device configured to combine a powder and a fluid in desired proportions to form a fluid/powder mixture is understood to be a mixer. For example, a metering chamber may also be a suitable mixer. It is also understood that a distributor refers to any device configured to disperse the fluid/powder mixture to the nozzles, each nozzle receiving a predetermined portion of the fluid/powder mixture. For instance, non-cone shaped members may be used in the distributor, such as a symmetric polygon. In addition, the dispenser 108, may include ribs on its outer surface to aid in dispersing the air/powder mixture. In some cases, the distributor may include a pump, or a series of pumps, for injecting desired portions of the mixture into the hoses connected to the nozzles. In other cases, conduits, other than hoses, may be used to connect the distributor with the nozzles.

What is claimed is:

1. A powder sprayer unit for a printing press, comprising:

a source of powder including a powder reservoir;

an air/powder mixer unit in fluid communication with said source of powder, said mixer unit comprising a mixing chamber assembly that includes a block constituting a single enclosure that forms a closed internal flow path for directing air and powder within said block, said internal flow path defined by an air inlet through which air is introduced into said block, a mixing chamber downstream of said air inlet within said block in which air from said air inlet and powder from said powder reservoir are thoroughly mixed, and an air/powder outlet downstream of said mixing chamber within said block through which the mixed air and powder exit said block, said block further including a cylindrical anilox roller that is rotatably mounted within said block between and directly adjacent said source of powder and said mixing chamber, the anilox roller including a plurality of indentations designed to carry powder such that rotation of said anilox roller transfers powder from said powder reservoir to said mixing chamber for mixture with air from said air inlet;

a scraper plate disposed between said powder reservoir and said anilox roller that limits the amount of powder that is delivered by said anilox roller to said mixing chamber;

a motor operably connected to said anilox roller that rotatably drives said anilox roller at a predetermined angular velocity;

a source of pressurized air in fluid communication with said air inlet formed within said block of said mixer unit;

a removable orifice device that controls the flow of air into said mixing chamber, said removable orifice device having an airflow orifice formed therein, said removable orifice device being insertable into an opening formed in said block of said mixer unit such that that said removable orifice device fits within said block with said air orifice positioned along said flow path within said block such that air supplied to said block via said air inlet passes through said orifice prior to entering said mixing chamber, said orifice thereby controlling the flow of air into said mixing chamber;

an air/powder mixture distributor in fluid communication with said air/powder outlet of said block, said air/powder mixture distributor including a substantially conical disperser configured so as to be positioned directly in the flow of the air/powder mixture and a plurality of internal passages, wherein said substantially conical disperser evenly distributes the air/powder mixture into said internal passages; and a plurality of nozzles in fluid communication with said internal passages of said air/powder mixture distributor, said nozzles being adapted to be positioned adjacent printed materials transported by the printing press;

wherein powder from said source of powder is passed into said mixing chamber by said anilox roller and is mixed with air supplied by said source of pressurized air to form a air/powder mixture which flows to said air/powder mixture distributor where it is distributed to said plurality of nozzles to be sprayed on the printed materials.

2. A mixer unit for combining air and powder into a mixture that is to be sprayed on a printed materials, comprising:

a block constituting a single enclosure that forms a closed internal flow path for directing air and powder within said block, said internal flow path defined by an air inlet through which air is introduced into said block, a mixing chamber downstream of said air inlet within said block in which air from said air inlet and powder from a powder reservoir are thoroughly mixed, and an air/powder outlet downstream of said mixing chamber within said block through which the mixed air and powder exit said block;

an anilox roller that is rotatably mounted within said block directly adjacent said mixing chamber, the anilox roller including a plurality of indentations designed to carry powder such that rotation of said anilox roller transfers powder to said mixing chamber for mixture with air from said air inlet;

a scraper plate adapted to be disposed between a source of powder and said anilox roller that limits the amount of powder that is delivered by said anilox roller to said mixing chamber; and a removable orifice device that controls the flow of air into said mixing chamber, said removable orifice device having an airflow orifice formed therein, said removable orifice device being insertable into an opening formed in said block such that said removable orifice device fits within said block with said air orifice positioned along said flow path within said block such that air supplied to said block via said air inlet passes through said orifice prior to entering said mixing chamber, said orifice thereby controlling the flow of air into said mixing chamber.

* * * * *